United States Patent [19]

Kobayashi

[11] 4,276,035

[45] Jun. 30, 1981

[54] DUCT SYSTEMS FOR WATER JET PROPULSION BOATS

[75] Inventor: Yoshiaki Kobayashi, Hamamatsu, Japan

[73] Assignee: Yamaha Hatsudoki Kabushiki Kaisha, Iwata, Japan

[21] Appl. No.: 4,814

[22] Filed: Jan. 19, 1979

Related U.S. Application Data

[63] Continuation of Ser. No. 812,379, Jul. 1, 1977, abandoned.

[30] Foreign Application Priority Data

Jul. 5, 1976 [JP] Japan ..... 51-88838

[51] Int. Cl.[3] ..... B63H 11/04

[52] U.S. Cl. ..... 440/47; 60/222; 440/38

[58] Field of Search ..... 114/151, 278; 60/221, 60/222; 440/38, 47, 68, 40–43

[56] References Cited

U.S. PATENT DOCUMENTS

| | | | |
|---|---|---|---|
| 807,769 | 12/1905 | Palmer | 115/42 |
| 985,187 | 2/1911 | Lindgren | 115/39 |
| 2,696,077 | 12/1954 | Goodman | 60/222 |
| 3,044,260 | 7/1962 | Hamilton | 115/16 X |
| 3,420,204 | 1/1969 | Samuel | 115/14 X |
| 3,752,110 | 8/1973 | Rhoda | 115/16 |
| 3,797,447 | 3/1974 | Stubblefield | 115/12 R |
| 3,805,731 | 4/1974 | Furst et al. | 115/16 |

*Primary Examiner*—Sherman D. Basinger
*Attorney, Agent, or Firm*—Donald D. Mon

[57] ABSTRACT

A water jet propelled boat hull having an axis of forward motion, a bottom and a centerline. A first and a second water duct are provided, each of which has an exit port discharging rearwardly, the exit ports being laterally spaced from the centerline and on opposite sides of the centerline from each other. Inlet ports are located substantially on the centerline at the bottom of the hull. The ducts interconnect respective inlet ports and respective exit ports. A first and a second water jet propulsion device, such as a pump, is disposed respectively in each of the said first and second ducts to move water from the inlet ports and out the exit ports. Because the inlet ports are on the centerline, both ducts will be provided with water, even when the boat is inclined as a consequence of making sharp turns.

13 Claims, 12 Drawing Figures

DUCT SYSTEMS FOR WATER JET PROPULSION BOATS

CROSS REFERENCE TO OTHER APPLICATION

This is a continuation of applicant's co-pending United States patent application Ser. No. 812,379, filed July 1, 1977, now abandoned.

This invention relates to duct means for water jet propulsion boats.

Water jet propulsion boats are known which include plural exit ports and plural water jet propulsion means. Their common disadvantage is that when multiple propulsion means are used, it has been customary to provide multiple intake ports on opposite sides of the centerline. When the hull inclines as a consequence of turns, it is not uncommon for one of the intake ports to rise out of the water. The respective propulsion means then runs dry, overspeeds, and does not provide propulsive force. It is an object of this invention to overcome this disadvantage.

This invention is carried out in combination with a boat hull having a centerline, a bottom, an axis of forward motion relative to the centerline, and a first and a second water duct, each duct having a respective exit port discharging rearwardly at the rear of the hull, said exit ports being laterally spaced from the centerline and on opposite sides of the centerline from each other. Inlet port means is located substantially on the centerline at the bottom of the hull. The ducts interconnect the inlet means and the respective exit port. A first and a second water jet propulsion means is disposed in respective first and second ducts to move water from the inlet means and out the exit ports.

According to a preferred but optional feature of the invention, each duct is provided with a respective inlet port, the inlet ports being aligned along the centerline of the bottom.

The above and other features of this invention will be fully understood from the following detailed description and the accompanying drawings, in which.

Figure 1A:
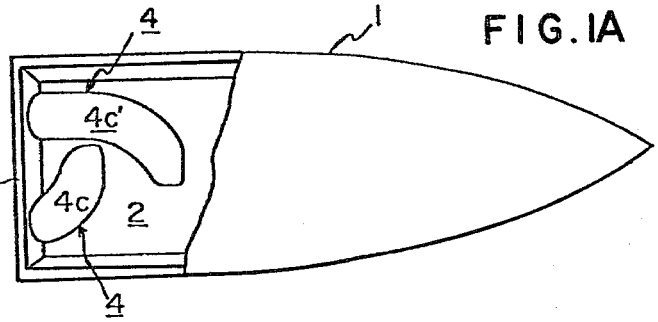
FIG. 1A is a top view of a hull incorporating the invention with a portion of the hull partially cut away.

The presently-preferred embodiment of the invention is shown in FIGS. 1A–1D, wherein a hull 1 includes a bottom 2 and a sternboard 3 at the rear end. The forward pointed end points to the right in these Figs. The centerline of the hull extends to the right and the left through the sharp-pointed bow and middle of the sternboard 3.

Duct means, generally designated by the numeral 4, includes two connecting ports 4A, 4B in the sternboard laterally spaced from the centerline and on opposite sides of the centerline from each other. In this embodiment, which utilizes a pair of outboard motors (one for each duct) as a part of the propulsion means, one for each of the ports 4A and 4B, the duct means 4 is continued by ducts 5*a* to an exit end. The propulsion means includes an impeller 5*b* in each duct driven by the respective outboard motor 5. The exit port 5*c* of the respective ducts is at the rearward discharge end. Intake ports 4*a*, 4*b* ("inlet means") are provided in the bottom 2 of the hull substantially on the centerline of the bottom. Intake ducts 4*c*, 4*c*' respectively connect to the impeller ducts 5*a*. Therefore, there is provided a pair of water ducts, each duct extending from a respective intake port to a respective exit port. Each of the ducts is at least partially formed in the hull.

Figure 1B:
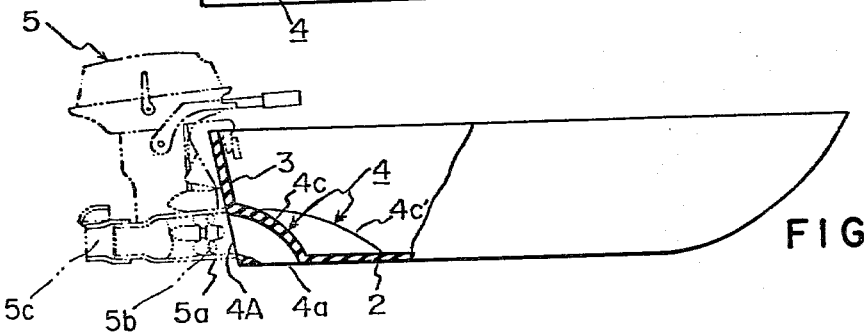
FIG. 1B is a partially-sectioned side elevation view taken at line B—B in FIG. 1C.
Figure 1C:
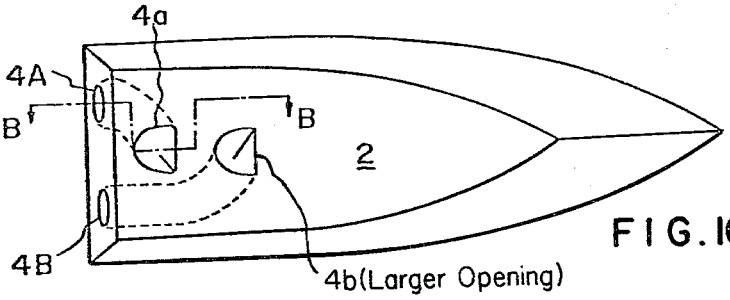
FIG. 1C is a bottom plan view.
Figure 1D:
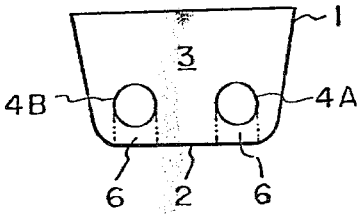
FIG. 1D is a back elevation view.
Figure 2A:
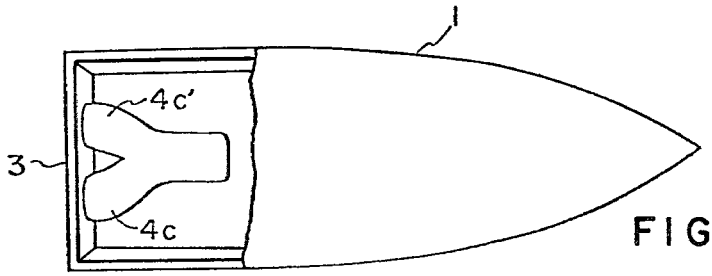
FIG. 2A is a plan view of another embodiment of the invention.
Figure 2B:
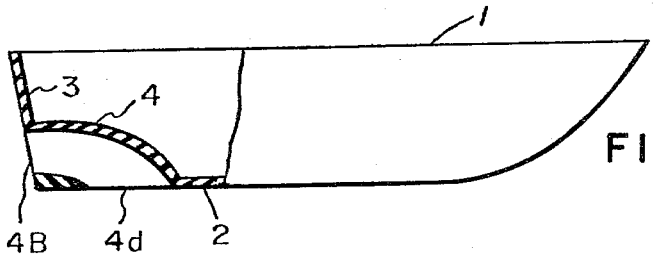
FIG. 2B is a partially-sectioned side elevation view taken at line b—b in FIG. 2C.
Figure 2C:
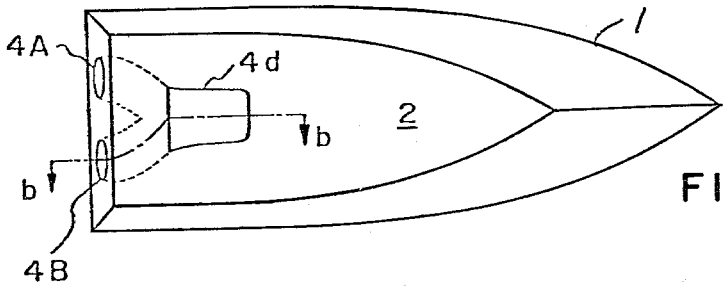
FIG. 2C is a bottom plan view of FIG. 2A.
Figure 2D:
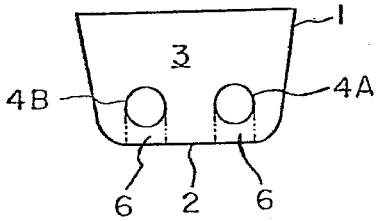
FIG. 2D is a back elevation view of FIG. 2A.

When the hull is formed of plastic material, such as glass fiber reinforced polyester resin, the intake ducts may be formed as channels, and then covered by a bottom member 6 as shown in FIG. 1D. This portion of the intake duct preferably has a circular cross-section.

As best shown in FIGS. 1C, 1D, 2C, 2D and 6, the bottom member 6 has a channel which together with the underside of the boat at that region forms the duct.

FIGS. 2A–2D show another embodiment of the invention. In this embodiment the intake ducts have a single common intake port, rather than respective individual intake ports. Similar parts bear respective numerals and letters as in FIGS. 1A–1D, but it will be noted that the intake ducts 4*c* and 4*c*' merge near the centerline at the bottom so that the water is taken into the water jet propulsion means through a single common intake port 4*d* ("inlet means").

The embodiments of FIGS. 1A–1D and 2A–2D relate to water jet propulsion means having outboard-type water jet propulsion means detachably secured to sternboard 3 of the boat. It is, of course, possible to utilize the invention with inboard water jet propulsion means wherein the engine is within the hull for driving impellers which can be located either inside of or outside of the hull.

Figure 3:
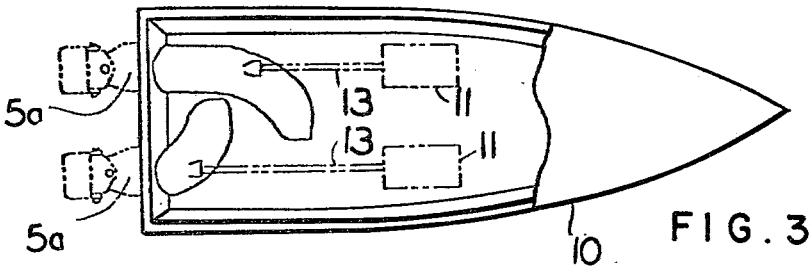
FIG. 3 is a plan view, with a portion of the deck partially cut away, of another embodiment of the invention.

For example, FIG. 3 shows a boat hull 10 substantially identical to that of FIG. 1A, but wherein two engines 11 drive respective impellers 12 (one in each duct) through drive shafts 13. The impeller and the impeller duct 5*a* lie to the rear of the hull, just as illustrated in FIG. 1B.

Figure 5:
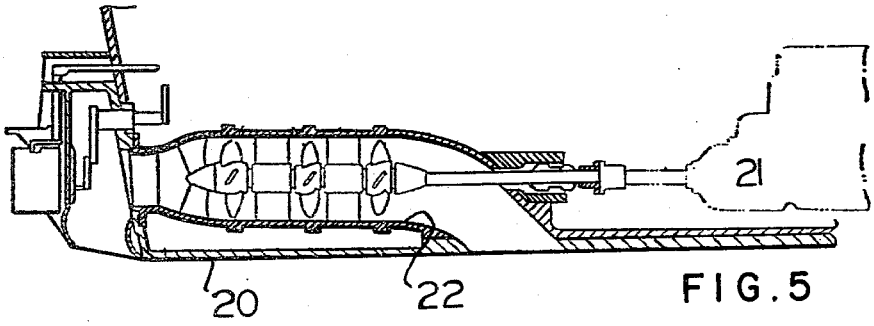
FIG. 5 is a fragmentary cross-section of another embodiment of the invention.

FIG. 5 shows a hull 20 which is substantially similar to hull 1 in FIG. 1A, with the exception that the engine 21 is inboard and the entire duct 22 is formed in the hull without substantial rearward protrusion.

Figure 4:
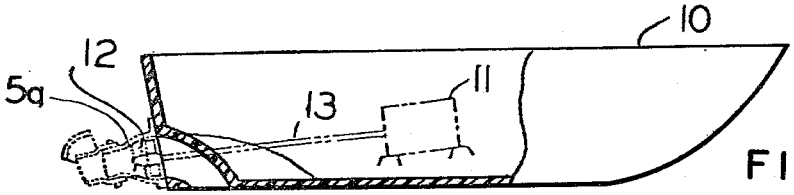
FIG. 4 is a partially-sectioned side elevation view of the hull of FIG. 3.

It should be understood that the engine and propulsion arrangements shown in FIGS. 3–5 may also be used in the embodiment of FIGS. 2A–2D.

Figure 6:
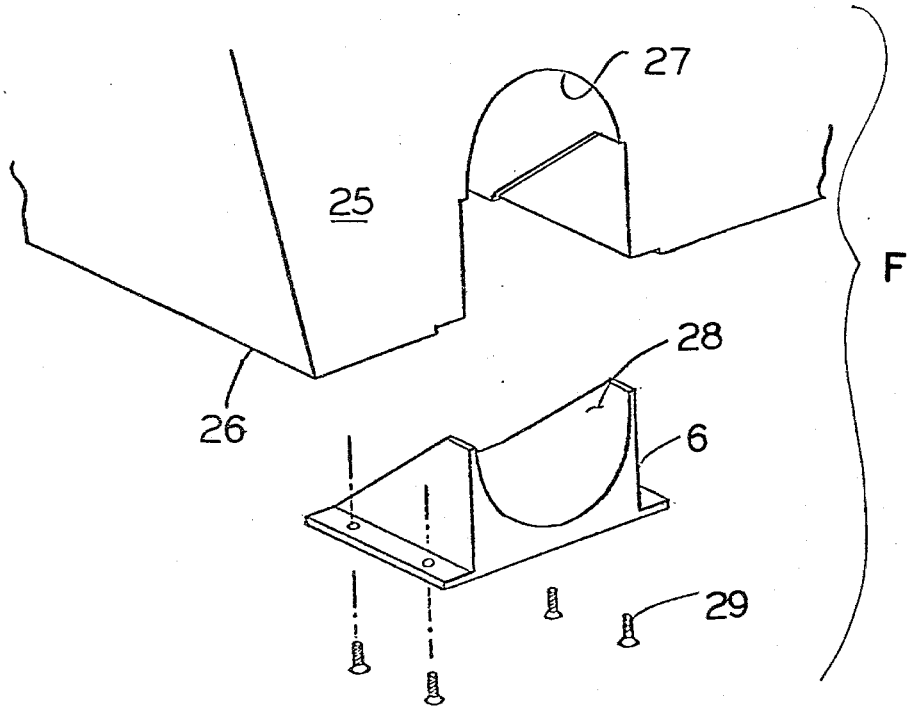
FIG. 6 is an exploded view showing a detail of construction useful with any embodiment of the invention.

A convenient means for forming the duct in the hull portion is shown in FIG. 6 where the rear end 25 of hull 26 is shown with channel 27 molded into the hull. A bottom member 6, having a curved surface 28, is attached to the bottom of the hull by fasteners 29. This bottom member may conveniently be made of an aluminum alloy or like strong material. In general, when the hull is made by molding, the manufacture is simplified by using the separate bottom member. It is, of course, possible to fabricate the intake ducts completely during the molding of the hull as shown by full lines in the drawings.

There may be some interference of flow through one duct by flow through the other in the embodiment of FIGS. 2A-2D, which is not encountered in the embodiment of FIGS. 1A-1D. However, due to the serial arrangement of the separate intake ports as shown in FIGS. 1A-1D, the flow resistances of the intake ducts may differ from each other due to the difference in the length of the ducts. Therefore, it will be preferred in the embodiment of FIGS. 1A-1D to equalize the flow resistance by enlarging the sectional area of the intake opening of the longer intake duct or by otherwise adjusting their flow resistance.

This invention thereby provides a convenient construction wherein both propulsion means will be effective at all times, even when the boat is tilted sharply during turns. The boat is therefore rendered more efficient and effective under all operating conditions.

This invention is not to be limited by the embodiments shown in the drawings and described in the description, which are given by way of illustration and not of limitation, but only in accordance with the scope of the appended claims.

I claim:

1. In combination: a boat hull capable of tilting sharply during turns, said hull having a centerline, an axis of forward motion relative to said centerline, a first longer and a second shorter water duct, a first and second exit port discharging rearwardly of the hull, said exit ports being laterally spaced from the centerline and on opposite sides of the centerline from each other, a first more forwardly and a second more rearwardly located inlet port means located on said centerline at the bottom of the hull, one located in front of the other, whereby to remain under water when said boat hull tilts sharply, said first and second water ducts respectively interconnecting said respective first and second inlet ports means and said first and second exit ports; and a first and a second water jet propulsion means disposed respectively in said first and second water ducts to move water from the respective first and second inlet port means and out the respective first and second exit ports, the cross section area defining flow resistance upstream from said first exit port being larger than the cross-section defining flow resistance upstream from said second exit port.

2. A combination according to claim 1 in which said cross-section areas defining flow resistance in said ducts create an inherent resistance to flow per unit length, the said unit resistance being greater in the shorter duct than in the longer duct, whereby to equalize the propulsive force of the jet streams exiting from the exit ports as generated by propulsion means of approximately equal power.

3. A combination according to claim 1 in which the ducts are partially formed as channels in the bottom of the hull, and bottom members attached to said hull, each of which bottom members includes a channel that forms part of the duct.

4. A combination according to claim 1 in which the ducts are partially formed in the hull, and in which the propulsion means comprise outboard engines and impellers which discharge through a continuation of the respective ducts.

5. A combination according to claim 4 in which the ducts are formed as channels in the bottom of the hull, and bottom members attached to said hull, each of which bottom members includes a channel that forms part of the duct.

6. A combination according to claim 1 in which the ducts are at least partially formed in the hull, and in which the propulsion means comprise inboard engines.

7. A combination according to claim 6 in which the propulsion means includes impeller means and a continuation of the ducts extending rearwardly behind the hull.

8. A combination according to claim 1 in which said cross-section areas are the inlet port means, said first inlet port means being larger than said second inlet port means.

9. A combination according to claim 8 in which the ducts are partially formed as channels in the bottom of the hull, and bottom members attached to said hull, each of which bottom members includes a channel that forms part of the duct.

10. A combination according to claim 8 in which the ducts are partially formed in the hull, and in which the propulsion means comprise outboard engines and impellers which discharge through a continuation of the respective ducts.

11. A combination according to claim 10 in which the ducts are formed as channels in the bottom of the hull, and bottom members attached to said hull, each of which bottom members includes a channel that forms part of the duct.

12. A combination according to claim 8 in which the ducts are at least partially formed in the hull, and in which the propulsion means comprise inboard engines.

13. A combination according to claim 12 in which the propulsion means includes impeller means and a continuation of the ducts extending rearwardly behind the hull.

* * * * *